US007774859B2

(12) United States Patent
Murray et al.

(10) Patent No.: US 7,774,859 B2
(45) Date of Patent: Aug. 17, 2010

(54) GARMENT WITH PLAYTHING

(75) Inventors: Elizabeth A. Murray, Middlesex (GB); Rebecca J. Nagan, Middlesex (GB)

(73) Assignee: Pocket Puppets Ltd., Shepperton, Middlesex (GB)

( * ) Notice: Subject to any disclaimer, the term of this patent is extended or adjusted under 35 U.S.C. 154(b) by 0 days.

(21) Appl. No.: 11/794,046

(22) PCT Filed: Dec. 22, 2005

(86) PCT No.: PCT/GB2005/005033

§ 371 (c)(1),
(2), (4) Date: Aug. 17, 2007

(87) PCT Pub. No.: WO2006/067484

PCT Pub. Date: Jun. 29, 2006

(65) Prior Publication Data

US 2008/0109930 A1 May 15, 2008

(30) Foreign Application Priority Data

Dec. 22, 2004 (GB) ..... 0428074.9

(51) Int. Cl.
*A41D 13/00* (2006.01)

(52) U.S. Cl. ..... 2/69; 2/75; 2/80; 2/247; 2/249; 2/250

(58) Field of Classification Search ..... 2/75, 2/80, 160, 247, 249, 250; 434/99, 395; 446/327
See application file for complete search history.

(56) References Cited

U.S. PATENT DOCUMENTS

| | | | | |
|---|---|---|---|---|
| 2,852,885 | A * | 9/1958 | Mayer | 446/327 |
| 3,308,479 | A * | 3/1967 | Sesco, Jr. | 2/50 |
| 3,447,165 | A * | 6/1969 | Brosk | 2/75 |
| 4,138,745 | A | 2/1979 | Greenspan | |
| 5,117,507 | A * | 6/1992 | Long | 2/158 |
| 5,516,321 | A * | 5/1996 | Kornbleuth | 446/28 |
| 6,233,763 | B1 * | 5/2001 | Spaan | 5/485 |
| 6,769,139 | B1 | 8/2004 | Goldkind | |
| 2005/0000001 | A1 * | 1/2005 | Goldkind | 2/227 |

* cited by examiner

*Primary Examiner*—Gary L Welch
*Assistant Examiner*—Alissa J Tompkins
(74) *Attorney, Agent, or Firm*—Dickstein Shapiro LLP

(57) ABSTRACT

In order to provide a garment which incorporates a plaything which can be operated within an element of surprise, the garment comprises a concealment space such as a pocket (2), in which a plaything such as glove puppet (8) can be stored. The concealment space comprises a concealment aperture (9). There is an operating aperture (10) through which a wearer may place their hand in order to operate the plaything. The plaything is configured to have a first position in which it is stored in an interior of the concealment space (2) and a second position in which it extends through the concealment space aperture (9).

10 Claims, 2 Drawing Sheets

GARMENT WITH PLAYTHING

The present invention relates to a garment which incorporates a plaything.

Garments for children (or, in some cases, for children's entertainers) may be provided with a plaything, such as a toy, attached to the garment or held in a pocket. The plaything may be essentially decorative or it may be played with at will by the wearer.

The present inventors have realised that great entertainment and delight can be provided if there is an element of surprise involved. Accordingly, the present inventors have set out to provide a garment which incorporates a plaything, which allows the plaything to be operated with this element of surprise.

The present invention provides a garment comprising a concealment space having a concealment space interior and in a concealment space aperture, a plaything, for example a glove puppet, and an operating aperture opening towards the concealment space interior and through which a user may place a hand to operate the plaything, the plaything having a first position in which it is stored inside the concealment space interior and a second position in which it extends from the concealment space aperture.

The present invention allows a plaything, such as glove puppet, to be stored in the concealment space interior where it can't be seen and, when the operator places their hand in the operating aperture as if they were simply placing their hand in their pocket, the plaything can be produced from another aperture in a surprising fashion.

The present invention further provides a kit, comprising a garment and a plurality of playthings, each plaything being releasably engageable with the garment, the garment comprising a concealment space having a concealment space interior and a concealment space aperture, and an operating aperture, opening towards the concealment space interior, wherein, when one of the plurality of playthings is engaged with the garment, a user may place a hand through the operating aperture to operate the plaything, the plaything having a first position in which it is stored inside the concealment space and a second position in which it extends from the concealment space aperture. The plaything engaged with the garment is preferably exchangeable with another plaything. Preferably, there are more playthings than there are concealment spaces.

Preferred and/or optional features of the invention will be described further below.

The garment may be any suitable type of garment. It may be child's garment or a garment for an adult, for example a children's entertainer. The garment preferably comprise a top garment, for example a shirt, coat, jacket, fleece top or waist coat.

Apart from the provision of the concealment space, the concealment space aperture, plaything and operating aperture, the garment may be standard in design.

The concealment space may comprise a space in which the plaything can be stored so that it cannot be seen in its first position. The concealment space suitably comprises a space inside the garment, for example next to the wearer's body, or a space within the lining of the garment. The concealment space may comprise a pocket, having a pocket interior and a pocket aperture.

The plaything may comprises a toy, but it is particularly preferred that the plaything comprises a glove puppet, into which the operator may place their hand. The glove puppet may be of any suitable design and appearance.

The plaything may be permanently fixed to the garment, releasably fixed to the garment or not fixed to the garment.

It is particularly preferred that the plaything comprises a glove puppet which is releasably connected to the garment. In this way, different types of glove puppet can be used, according to the inclination of the wearer. By providing releasable engagement of the glove puppet to the garment, the likelihood of glove puppet becoming lost is reduced. The glove puppet may be detached from the garment for washing.

The plaything may be fixed or releasably fixed to the concealment space interior, to the concealment space aperture, the operating aperture or to any other part of the garment.

The operating aperture which communicates with the concealment space comprises a separate aperture to the concealment space aperture. They may be displaced from one another by a suitable distance, for example at least 5 cm. At least one of the concealment space aperture and operating aperture may resemble a conventional pocket. The other one may be concealed within the garment. For example, the operating aperture may be formed in the seam or welt of the garment so that it is not readily visible.

The operating aperture may communicate directly with the concealment space interior or there may be an operating channel extending from the operating aperture towards the concealment space interior.

It is possible that, where a glove puppet is used, the glove puppet may close the passage from the operating aperture to the concealment space interior. This can help to prevent other objects placed in the operating aperture and becoming lost accidentally.

The concealment space aperture and the operating aperture may each comprise a closure, for example a pocket flap, zip closure, press stud closure, button closure, touch and hold fastener such as VELCRO (trade mark) or the like.

The concealment space aperture is most suitably configured so that, when the plaything is in its second position, it extends on the front of the garment, preferably in the region of the top part of the wearer's body, suitably adjacent the trunk, for example, the chest of the wearer.

The plaything may be moved from its first position to its second position directly by the wearer's hand or by a mechanism which is operable through the operating aperture and which extends from the operating aperture to the concealment space. For example, there may be operating strings, an operating rod or operating springs.

In the case of a glove puppet, when the glove puppet is in the second position, the puppet may be moved in a conventional manner by the wearer's hand which is placed through the operating aperture.

The garment of the present invention is particularly suitable for children in the age range 2-6 years old.

Where the plaything comprises a glove puppet, having a top surface and a bottom surface, there may be first connectors on the top surface for releasable connection to corresponding first connectors on the operating aperture or in the concealment space interior, and there may be a second connectors on the second surface for releasable connection to corresponding second connectors formed on an opposite side of the operating aperture, the first and second connectors of the operating aperture being releasably engageable with one another, if the glove puppet is not engaged with the first and second connectors of the operating aperture.

A garment according to the invention may include more than one plaything, concealment space and operating aperture.

The present invention will be further described by way of example only with reference to the accompanying drawings, in which,

DETAILED DESCRIPTION OF THE DRAWINGS

Figure 1:
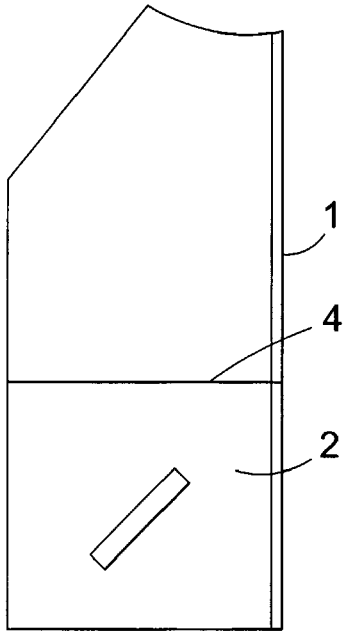
FIG. 1 shows a plan view of a panel of a garment according to the present invention.
Figure 2:
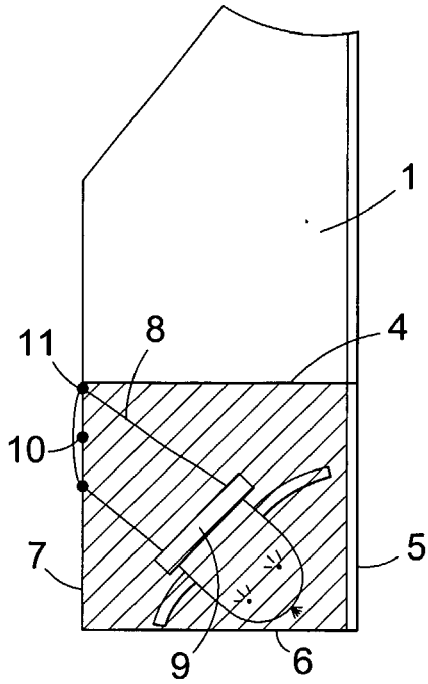
FIG. 2 shows the panel of FIG. 1, showing the concealment space and the glove puppet in its first position.
Figure 4:
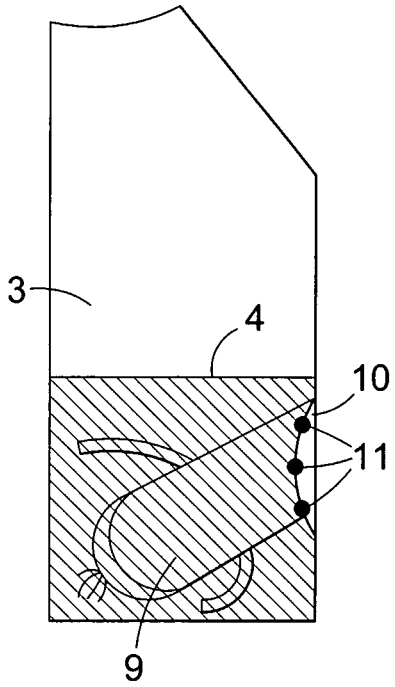
FIG. 4 is a rear view of the panel of FIG. 1 showing the position the figure of the glove puppet in the first position.

FIG. 1 shows a panel 1 of a garment. The garment may comprise any suitable top garment, for example, a shirt, jacket, fleece, body warmer, coat or other garment. In many respects panel 1 is of conventional construction. However, the panel 1 comprises a concealment space defined between a front sheet of the panel 2 and the lining 3 (see FIG. 4). The concealment space is defined at the top by a seam 4. On the other sides 5, 6 and 7, it is defined by seams of the panel 1.

Inside the concealment space there is a glove puppet 8 stored in a first position in which it is not visible. The concealment space further includes on its front face a concealment space aperture which resembles a conventional pocket opening 9. There is an operating aperture 10 formed in the welt seam on the left hand side. The glove puppet 8 is fixed to the operating aperture 10 by connectors 11 which will be described further below.

Figure 3:
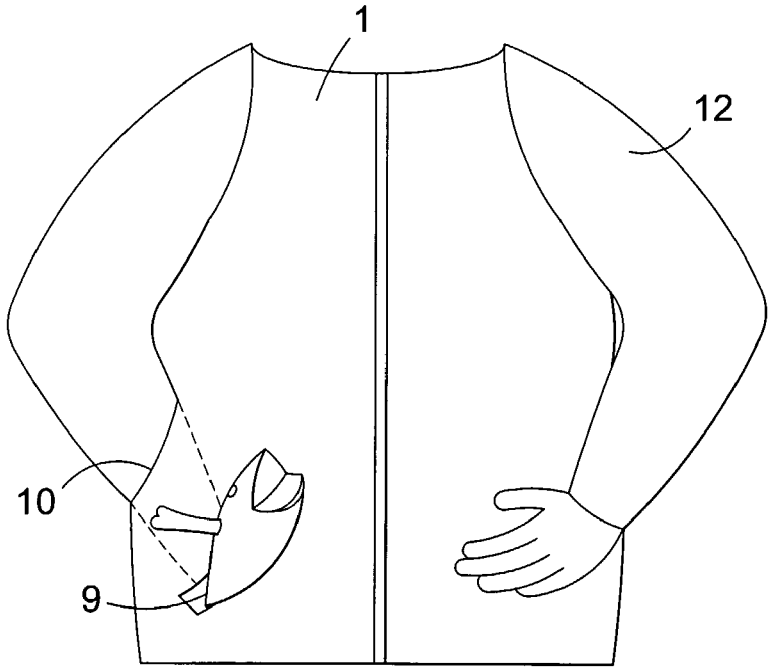
FIG. 3 shows the panel of FIG. 1, integrated into a jacket and showing the glove puppet in its second position.

FIG. 3 shows the panel 1 integrated into a garment 12 in the form of a jacket. In use, a wearer can place their right hand through the operating aperture 10 so that the hand extends into the glove puppet 9 in the concealment space 2. In this configuration, the wearer can operate the glove puppet by moving it so that it extends through the concealment space aperture 9 in FIG. 3.

Figure 5:
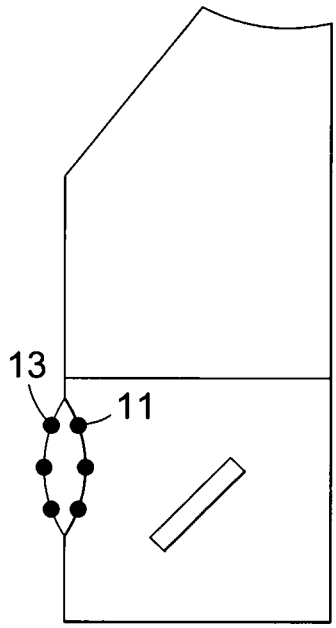
FIG. 5 shows a detail of the panel of FIG. 1.
Figure 6:
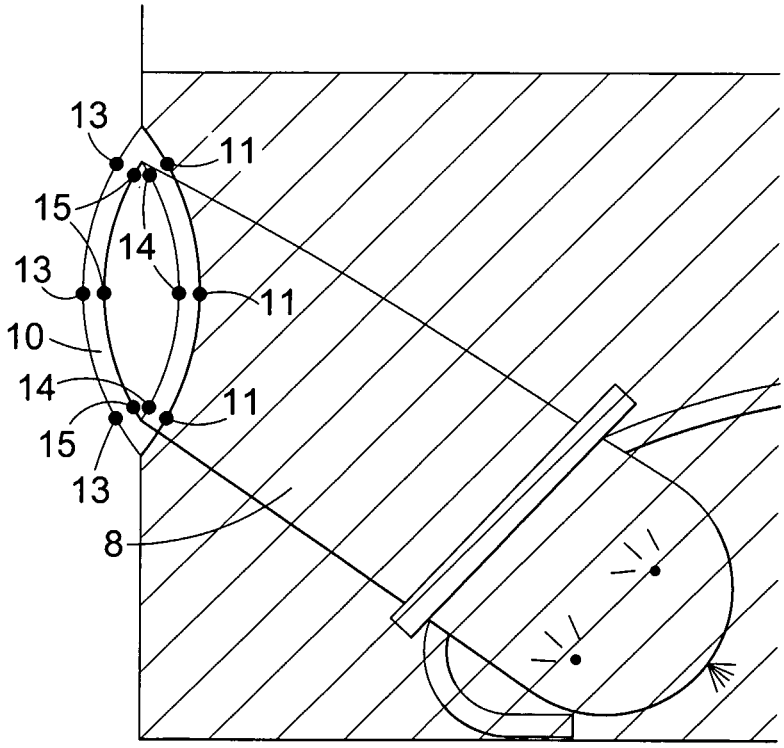
FIG. 6 is a detail, at a large scale, showing how the glove puppet is fixed to the operating aperture.

FIGS. 5 and 6 show further details of the connectors 11, 12, 13, 14 between the operating aperture and the glove puppet 8.

In FIGS. 5 and 6, connections are formed by press stud engagement between a first set of male connectors, 11 formed on a first side of the operating aperture and a first set of female press stud connectors 14 formed on the front face of the glove puppet 8. This fixes the upper surface of the glove puppet to the front face of the operating aperture 2. Similarly, a second set of male connectors 15 are formed on the bottom face of the glove puppet 8 so that they can be engaged with a second set of female connectors 13 formed on the rear face of the operating aperture 10.

By interengagement of the respective male and female press studs 11, 13, 14 and 15, the glove puppet can be releasably secured to the garment. The glove puppet can be disconnected from the aperture connections, for example to replace it with another glove puppet or for washing.

When the glove puppet is removed from the garment, the male studs 11 are engageable with the corresponding female studs on the opposite side of the operating aperture 13, so that the operating aperture can be closed.

The present invention has been described above by way of example only and modifications can be made within the invention. The present invention also extends to any combination of any individual features described or implicit herein or shown or implicit in the drawings. The present invention further extends to any generalisation of any such features or combination.

The invention claimed is:

1. A garment comprising:

a concealment space having a concealment space interior and a concealment space aperture, a plaything, the plaything having a first position in which it is stored inside the concealment space and a second position in which it extend from the concealment space aperture, an operating aperture, opening towards the concealment space interior, through which a user may place a hand to move the plaything from the first position to the second position and operate the plaything, wherein the plaything is a glove puppet and is releasably fixed to the operating aperture.

2. A garment according to claim 1, wherein the plaything comprises a glove puppet.

3. A garment according to claim 1, comprising a top garment.

4. A garment according to claim 1, wherein the concealment space comprises a pocket.

5. A garment according to claim 1, wherein the concealment space aperture, operating aperture or both of them comprise closures for releasably closing the aperture.

6. The garment according to claim 1, wherein the glove puppet comprises a first surface having a first connector for engaging a connector on a first side of the operating aperture, the glove puppet further having a second surface having a second connector for engaging a second connector on a second side of the operating aperture.

7. A garment according to claim 6, wherein, if the glove puppet is not engaged with respective connectors of the operating aperture, the connectors of the operating aperture may be releasably connected to one another.

8. A kit, comprising:

a garment and a plurality of playthings, each plaything being releasably engageable with the garment, the garment comprising:

a concealment space having a concealment space interior and a concealment space aperture, and an operating aperture, opening towards the concealment space interior, wherein, when one of the plurality of playthings is engaged with the garment, the plaything has a first position in which it is stored inside the concealment space and a second position in which it extend through the concealment space aperture, and a user may place a hand through the operating aperture to move the plaything from the first position to the second position and operate the plaything, and wherein the plaything is a glove puppet and is releasably fixed to the operating aperture.

9. A garment comprising:

a concealment space having a concealment space interior and a concealment space aperture, a plaything, releasably connected within the concealment space to a part other than the concealment space aperture, the plaything having a first position in which it is stored inside the concealment space and a second position in which it extends through the concealment space aperture, an operating aperture, opening towards the concealment space interior, through which a user may place a hand to move the plaything from the first position to the second position and operate the plaything, wherein the plaything is a glove puppet and is releasably fixed to the operating aperture.

10. A kit, comprising:

a garment and a plurality of playthings, each plaything being releasably engageable with the garment, the garment comprising:

a concealment space having a concealment space interior, a concealment space aperture, and an operating aperture opening towards the concealment space interior, wherein, when a selected one of the plurality of playthings is engaged with the garment, the selected plaything has a first position in which it is stored inside the concealment space and a second position in which it extends through the concealment space aperture, and a user may place a hand through the operating aperture to operate the plaything to move the plaything from the first position to the second position and operate the plaything, and wherein the plaything is a glove puppet and is releasably fixed to the operating aperture.

* * * * *